US006373444B1

(12) United States Patent
Schadler

(10) Patent No.: US 6,373,444 B1
(45) Date of Patent: Apr. 16, 2002

(54) COMMON APERTURE UHF/VHF HIGH BAND SLOTTED COAXIAL ANTENNA

(75) Inventor: John L. Schadler, Raymond, ME (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/800,998

(22) Filed: Mar. 8, 2001

(51) Int. Cl.[7] ..... H01Q 13/10
(52) U.S. Cl. ..... 343/770; 343/768
(58) Field of Search ..... 343/767, 770, 343/771, 890, 891, 768

(56) References Cited

U.S. PATENT DOCUMENTS 2,658,143 A * 11/1953 Fiet et al. ..... 343/770
2,981,947 A * 4/1961 Bazan ..... 343/770
4,631,544 A * 12/1986 Ploussios ..... 343/771
5,021,797 A * 6/1991 Dienes ..... 343/727
5,929,821 A * 7/1999 Goldstein et al. ..... 343/770
6,137,448 A * 10/2000 Schadler ..... 343/770

* cited by examiner

*Primary Examiner*—Don Wong
*Assistant Examiner*—Hoang Nguyen
(74) *Attorney, Agent, or Firm*—Baker & Hostetler, LLP

(57) ABSTRACT

A slotted coaxial antenna design that accomplishes simultaneous DTV and NTSC broadcast with minimal tower wind loading, is disclosed. In a preferred embodiment, the antenna design comprises a VHF slotted coaxial antenna that acts as a framework to house multiple UHF slotted coaxial antennas. The one or more UHF slotted coaxial antennas, which each acts as an UHF outer conductor, and one or more VHF couplers, that surrounds the VHF inner conductor, configures an arrangement such that the UHF antennas and VHF couplers share a common aperture; namely, the VHF antenna. This antenna design allows for high band VHF/UHF broadcast of DTV and NTSC signals while being easily adaptable to existing slotted coaxial antennas.

20 Claims, 10 Drawing Sheets

COMMON APERTURE UHF/VHF HIGH BAND SLOTTED COAXIAL ANTENNA

FIELD OF INVENTION

The present invention generally relates to the field of slotted coaxial antenna designs. More particularly, the present invention relates to the design of a slotted coaxial antenna that would allow for simultaneous DTV and NTSC broadcast with equal or less windload than present VHF only antenna designs.

BACKGROUND OF THE INVENTION

The majority of Ultra High Frequency (UHF) antennas used in National Television System Committee (NTSC) antenna systems are slotted coaxial designs. UHF slotted coaxial antennas gained widespread use in NTSC broadcasting because of their above-average performance characteristics; namely, excellent omni-directional azimuth patterns, low wind loads, and smooth null fill.

While the foregoing performance characteristics are also desirable for digital television (DTV) transmission, the more stringent antenna output performance standards of DTV transmission cannot be met with current slotted coaxial antenna designs. At the present stage of antenna development, the antenna output response performance across multiple channels, which was given little consideration in NTSC systems, is now an important parameter for DTV transmission.

For example, when used as television broadcasting antennas, slotted coaxial antennas are generally optimized to transmit signals for a specified television channel having a six MHz band width. For NTSC transmission, the power distribution across this six MHz band width is concentrated at three basic carrier frequencies; namely, picture, color and aural. Therefore, the performance of the antenna is critical only at these three carrier frequencies.

However, for DTV transmission, the power is equally distributed across a 5.4 MHz band width span within the 6 MHz band width. Therefore, the antenna's performance is critical across the substantially operating band. This means that the antenna's elevation pattern must remain stable (i.e. unchanged) at all frequencies within the channel, and not just at isolated frequencies.

In addition, there are over 400 Very High Frequency (VHF) television stations that have already been assigned UHF DTV channels. As a practical matter then, the onset of DTV has thus complicated the antenna selection decision for broadcasters who must now operate DTV antenna systems simultaneously with their existing NTSC antenna systems. It would be desirable therefore to provide a coaxial antenna that would allow for simultaneous DTV and NTSC broadcast with equal or less tower wind loading than present VHF only antennas.

SUMMARY OF THE INVENTION

The antenna of the present invention satisfies to a great extent the foregoing need for an improved slotted coaxial antenna design.

In one aspect of the invention a slotted coaxial antenna constituting a replacement antenna useful as a DTV and NTSC antenna system, is provided. The slotted coaxial antenna comprises an elongated cylindrical hollow mast. The mast acts as an outer conductor.

On the outside of the mast is arranged a plurality of substantially equidistant longitudinally extending spaced slots. In one embodiment, there are four VHF coupled slots and four UHF coupled slots arranged in alternating fashion. Each slot is formed in the mast for the purpose of radiating electromagnetic energy. Alternatively and optionally, each slot in the cylindrical mast may be of varying width and length for the purpose of varying the radiating field and ultimately the usable band width of the antenna.

On the inside, the mast coaxially surrounds a longitudinally extending VHF inner conductor, which consists of a VHF slotted coaxial antenna. In one embodiment, the VHF inner conductor is surrounded equidistantly by four UHF slotted coaxial antennas, which each acts as a UHF outer conductor contained within the mast. Interposed between each UHF slotted coaxial antenna is a VHF coupler (also totaling four) such that the four UHF antennas and the four VHF couplers share a common aperture; namely, the VHF antenna. Each coupler (VHF or UHF) is located on the inside of the mast between the ends of each longitudinal slot.

A significant result of this slotted coaxial antenna design is an antenna output response performance that is suitable for VHF high band and UHF DTV broadcasts.

Another significant result is the achievement of DTV and NTSC signal coverage with equal or less tower wind loading than current VHF only antennas.

As a practical matter, the common aperture UHF/VHF high band slotted coaxial antenna of the present invention also results in substantial economic savings, since the broadcast of NTSC and DTV signals can be transmitted from one common antenna. Moreover, it is adaptable to existing slotted coaxial antennas.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE PREFERRED EMBODIMENTS

DETAILED DESCRIPTION OF PREFERRED EMBODIMENTS

Figure 1:
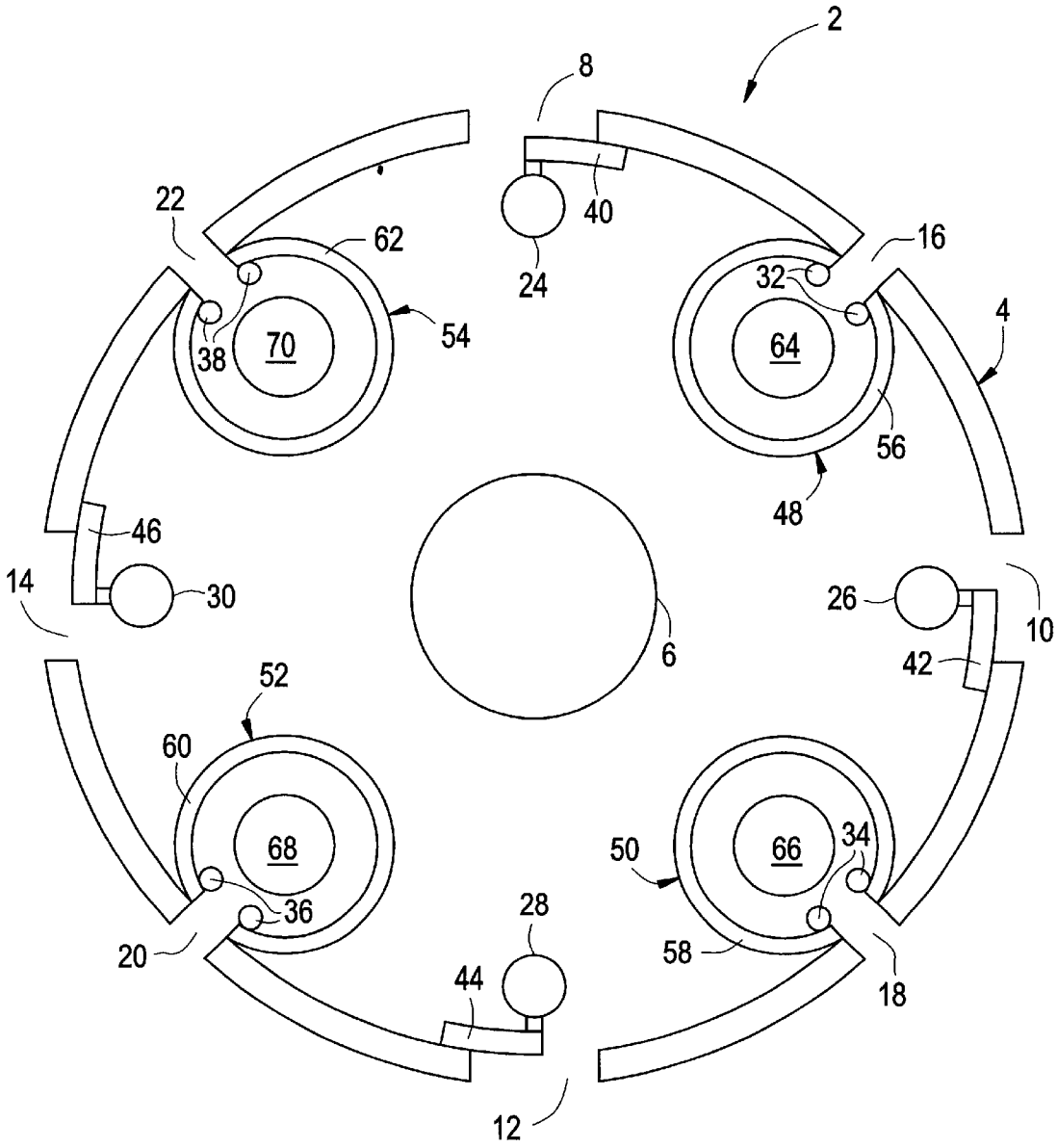
FIG. 1 is a top view of a common aperture UHF/VHF high band slotted coaxial antenna in accordance with a preferred embodiment of the present invention.

Referring now to the figures wherein like reference numerals indicate like elements, in FIG. 1, there is shown one embodiment of a high band VHF/UHF common aperture slotted coaxial antenna 2. The common aperture slotted coaxial antenna 2 comprises an elongate, cylindrical hollow mast 4, which surrounds a VHF slotted coaxial antenna that acts as a VHF inner conductor 6. The mast 4 acts as an outer conductor.

A plurality of longitudinally spaced slots 8, 10, 12, 14, 16, 18, 20, 22 are formed on the outside of the mast. Four are VHF coupled slots 8, 10, 12, 14, and four are UHF coupled slots 16, 18, 20, 22. Each VHF slot 8, 10, 12, 14 is arranged in an alternating fashion to the UHF slots 16, 18, 20, 22, as shown in FIG. 1.

On the inside, the mast 4 comprises a plurality of couplers 24, 26, 28, 30, 32, 34, 36, 38, one or more of which is associated with each UHF or VHF slot 8, 10, 12, 14, 16, 18, 20, 22. More specifically, the VHF couplers 24, 26, 28, 30 are disposed immediately adjacent VHF slots 8, 10, 12, 14. Similarly, the UHF couplers 32, 34, 36, 38 are arranged immediately adjacent UHF slots 16, 18, 20, 22.

Construction of the VHF couplers 24, 26, 28, 30 differs from the construction of the UHF couplers 32, 34, 36, 38. Each VHF coupler 24, 26, 28, 30 is suitably secured to the inside of mast 4 by an L-shaped bracket 40, 42, 44, 46, respectively, preferably made of aluminum. The VHF couplers 24, 26, 28, 30, via brackets 40, 42, 44, 46, respectively, are arranged to extend inside a portion of the length of the associated VHF slots 8, 10, 12, 14, respectively.

On the other hand, each UHF coupler 32, 34, 36, 38 comprise two cylindrical coupler rods, which form a part of the four UHF antennas 48, 50, 52, 54, respectively. As shown in FIG. 1, each cylindrical coupler rod 32, 34, 36, 38 is arranged opposite each other along a portion of the length of the associated UHF slot 16, 18, 20, 22, respectively. In addition, each cylindrical coupler rod 32, 34, 36, 38 has a space therebetween, which space corresponds to the width of the associated slot 16, 18, 20, 22, respectively. This space is the only opening in the UHF antennas 48, 50, 52, 54, respectively.

Each UHF antenna 48, 50, 52, 54 comprises an outer conductor 56, 58, 60, 62, respectively, and an inner conductor 64, 66, 68, 70, respectively. By the above-mentioned arrangement, the VHF outer conductor acts as a common aperture for the four alternating UHF slotted coaxial antennas 48, 50, 52, 54 and VHF couplers 24, 26, 28, 30 that are located inside of the mast 4.

Figure 2:
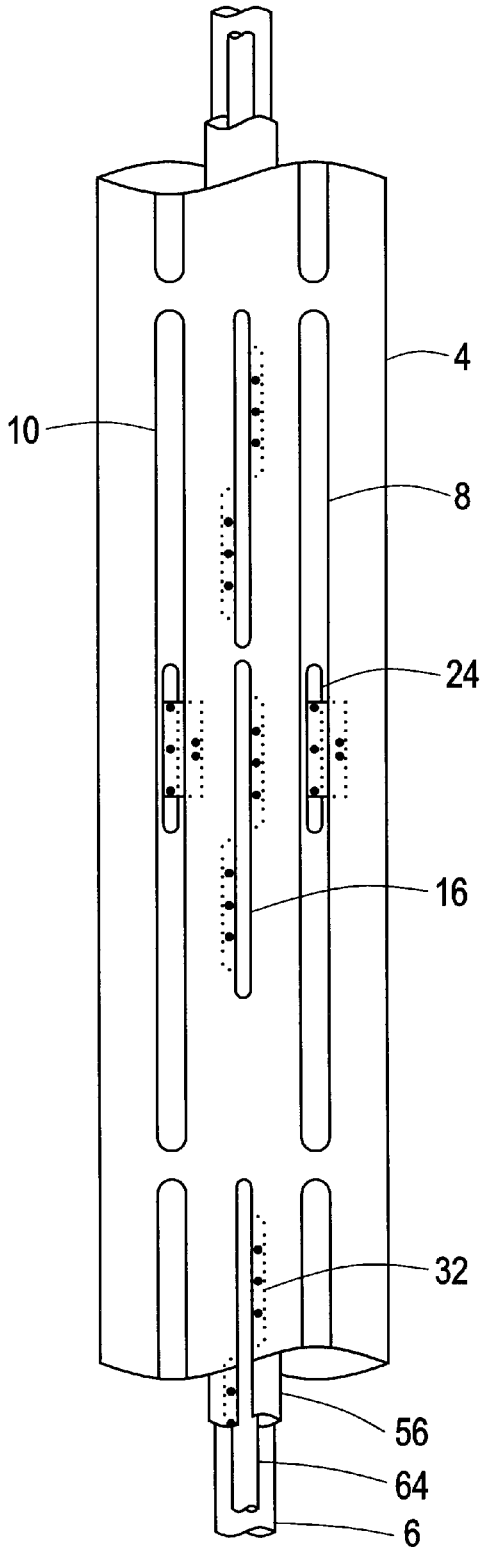
FIG. 2 is a front view of the slotted coaxial antenna of FIG. 1.

Referring now to FIG. 2, there is shown a front view of the improved slotted coaxial antenna design of FIG. 1. There is shown, for example, the elongate, hollow mast 4 having a plurality of longitudinally spaced slots, as at 8. The mast 4 is constructed of a suitable material, such as steel or aluminum.

In a preferred embodiment, each slot in the cylindrical mast 4 may be of varying width and length for the purpose of varying the radiating field and ultimately the usable band width of the antenna. VHF slot 10 is shown to have an approximate length more than twice the length of two UHF coupled slots 16. The reason for this configuration is because the wavelength of the carrier frequencies for the VHF high band (i.e. channels 7 to 13) is more than twice the wavelengths of the carrier frequencies for the UHF band (i.e. channels 14 to 69).

Employing two couplers 32 in the UHF slot 16 also serves to produce more coupling from the smaller diameter couplers 32. Note that a single coupler may be used in each UHF slot 16. However, using a single coupler would require a larger sized diameter coupler, which may not feasible. Given the space restriction, use of a single coupler would lead to undesirable power handling issues.

Moreover, each slot is associated with a particular UHF or VHF coupling mechanism. Within VHF slot 8, for example, is shown a VHF coupler 24.

FIG. 2 also illustrates the VHF inner conductor 6, which is surrounded by a plurality of similarly situated UHF antennas having an outer conductor 56 and an inner conductor 64.

Figure 3:
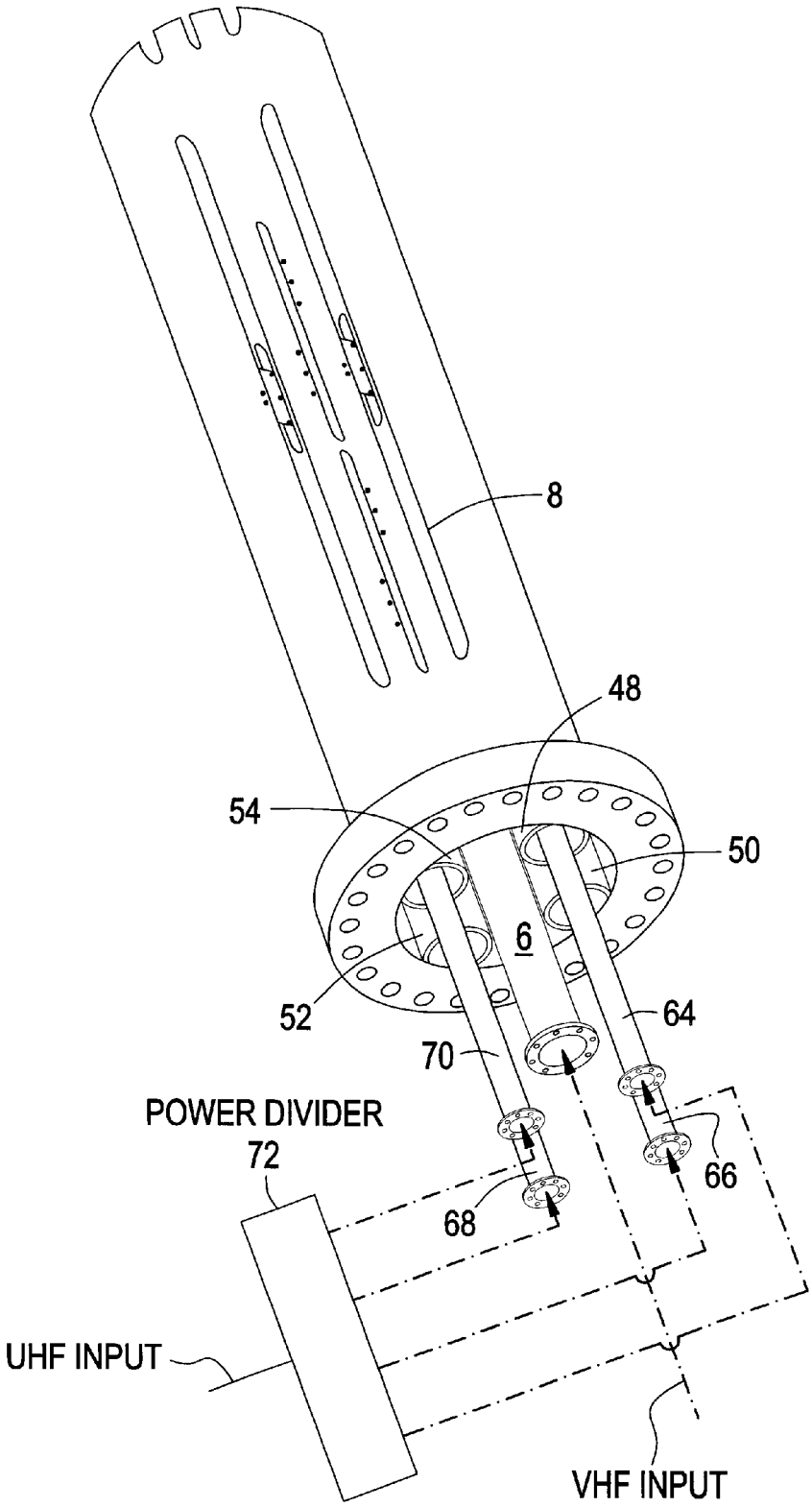
FIG. 3 is a side perspective view of the slotted coaxial antenna of FIG. 1.

FIG. 3 is a side perspective view of the improved slotted coaxial antenna of FIG. 1, illustrating the approximate spatial arrangement of the UHF antennas 48, 50, 52, 54. FIG. 3 also illustrates the concept of employing a power divider 72 if more than a single, internally attached UHF exists. The power divider 72 is used to reduce the input from four to a single connection.

It is important to recognize that by changing one or a combination of factors, a multitude of azimuth patterns can be achieved for both UHF and VHF broadcast. These factors include: the outer mast diameter; the number of slots (both UHF and VHF) around the mast; the position of the UHF and VHF slots around the mast; addition of fins to the mast; and external lines (i.e. metallic lines running the full length of the antenna) placed in the aperture. Any one of these factors can be used as a successful method of scattering the antenna's radiation and consequently changing the shape of the azimuth patterns of the slotted coaxial antenna.

FIGS. 4 through 10 illustrates how variations in the above-mentioned factors shape or directionalize both the azimuth pattern of the VHF radiating channel and the UHF radiating channel. These figures show that the VHF and UHF azimuth patterns do not necessarily have to be the same shape. In effect, since the UHF and VHF slots work independently of each other, their patterns can be shaped in numerous combinations.

Figure 4:
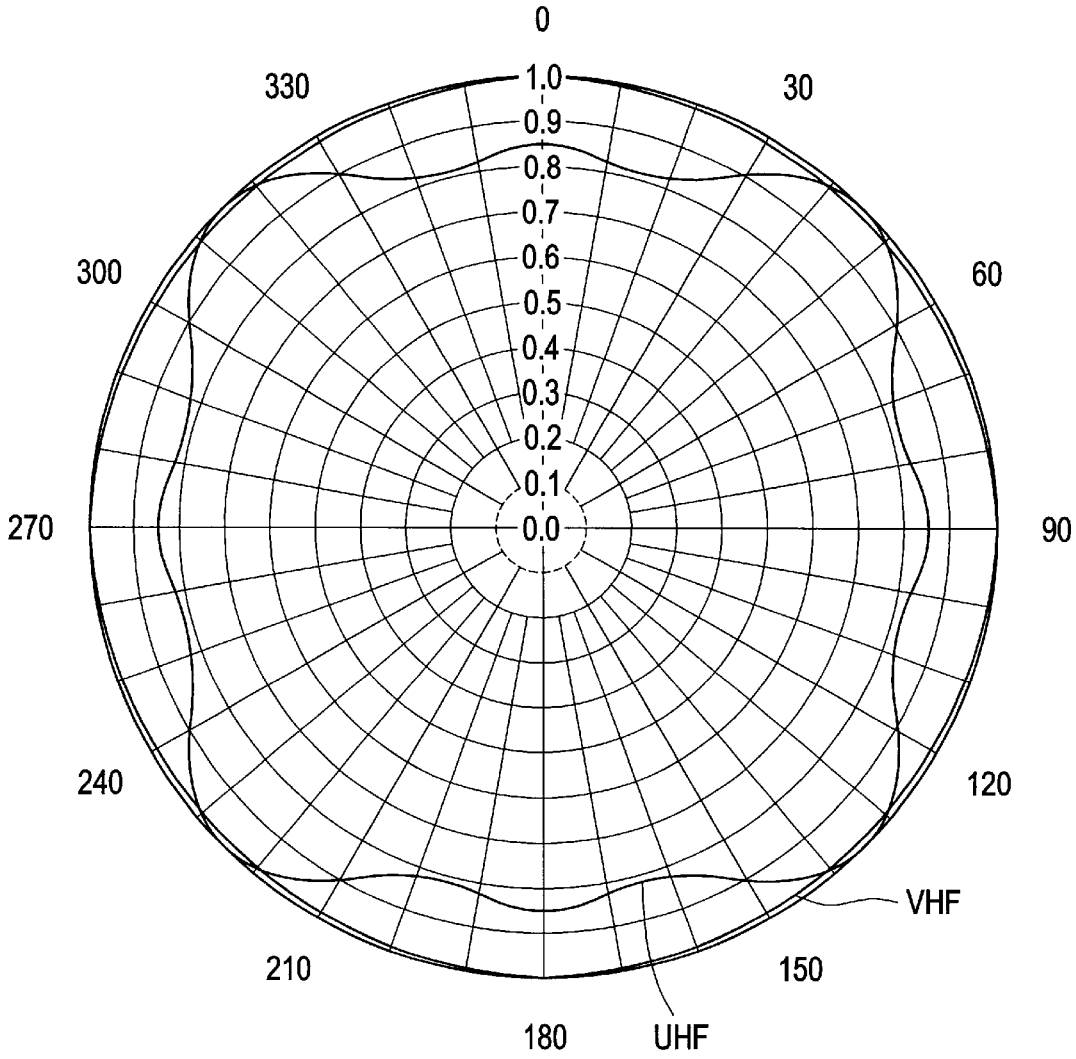
FIG. 4 is a graph depicting the UHF and VHF azimuth patterns corresponding to the slotted coaxial antenna design of FIG. 1.

For instance, the azimuth pattern corresponding to the slotted coaxial antenna design of FIG. 1 is shown in FIG. 4.

Figure 5:
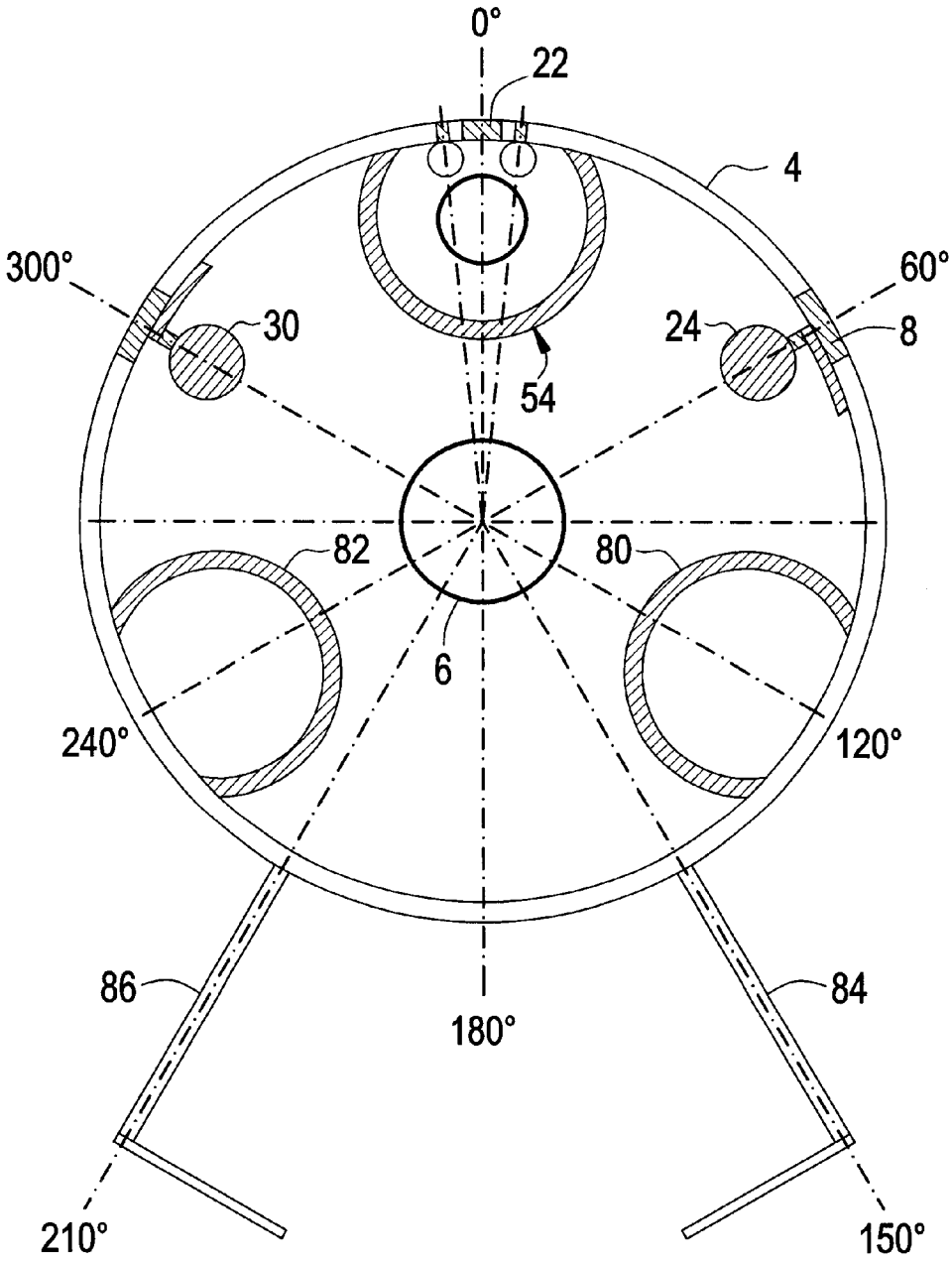
FIG. 5 is a top view of a second embodiment of the common aperture slotted coaxial antenna of the present invention.

Referring now to FIG. 5, there is shown a third embodiment of the common aperture slotted coaxial antenna design of the present invention. In this configuration, orientation of the VHF coupled slot 8 and associated coupler 24 is rotated approximately 60 degrees to the left or right of its position shown in FIG. 1.

In addition to a change in orientation, the present embodiment presents changes to the number of VHF couplers and UHF antennas. More specifically, the number of VHF couplers have been reduced from four in FIG. 1 to two 24, 30, which are positioned at approximately 60 and 300 degrees, respectively, as shown in FIG. 5.

Similarly, FIG. 5 shows a reduction in the number of UHF antennas from four in FIG. 1 to one 54, which is positioned at zero degrees. To maintain symmetry within the hollow mast 4, as well as to balance the VHF couplers, two empty tubes 80, 82, positioned at 120 and 240 degrees, respectively, are included. Note that there are no slots in the periphery of the mast 4 associated with each empty tube 80, 82.

Figure 6:
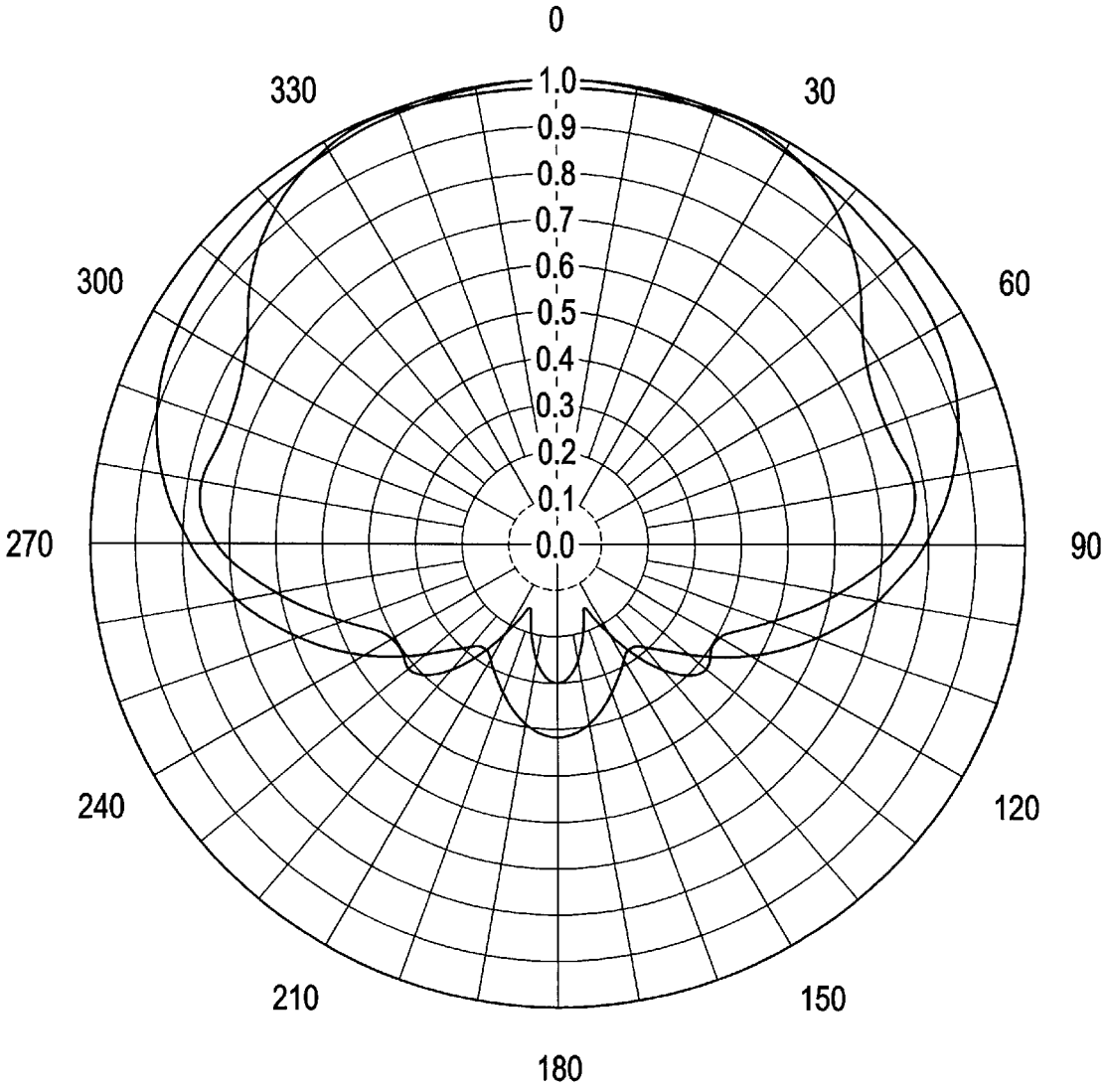
FIG. 6 is a graph depicting UHF and VHF azimuth patterns corresponding to the slotted coaxial antenna design of FIG. 5.

Finally, fins 84, 86, positioned approximately at 150 and 210 degrees, respectively, are included in this configuration for the purpose of shaping the azimuth patterns of both the VHF and UHF radiating frequencies as desired. The azimuth pattern corresponding to the slotted coaxial antenna design of FIG. 5 is shown in FIG. 6.

Figure 7:
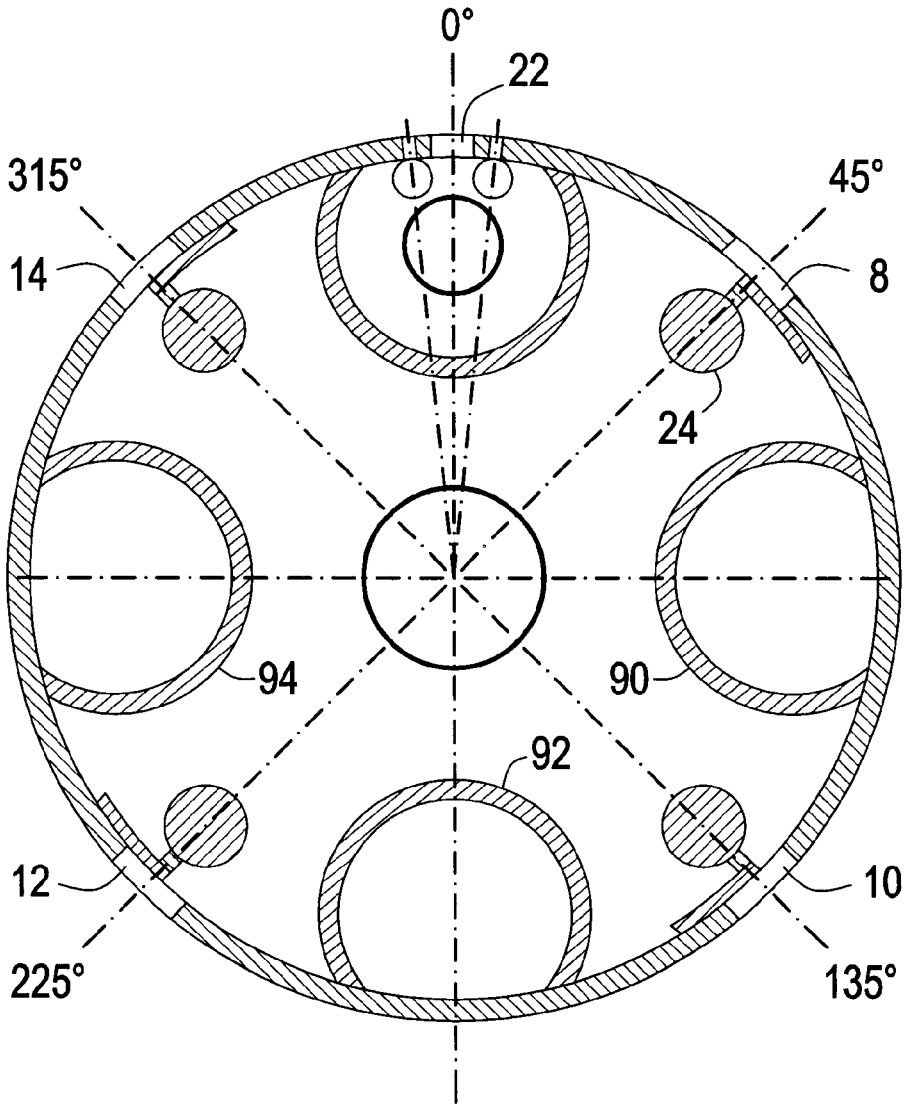
FIG. 7 is a top view of a third embodiment of the common aperture slotted coaxial antenna of the present invention.

Referring to FIG. 7, there is shown a top view of a third embodiment of the common aperture slotted coaxial antenna of the present invention. In this configuration, orientation of the VHF coupled slot 8 and associated coupler 24 is rotated approximately 45 degrees to the left or right of its position shown in FIG. 1.

Figure 8:
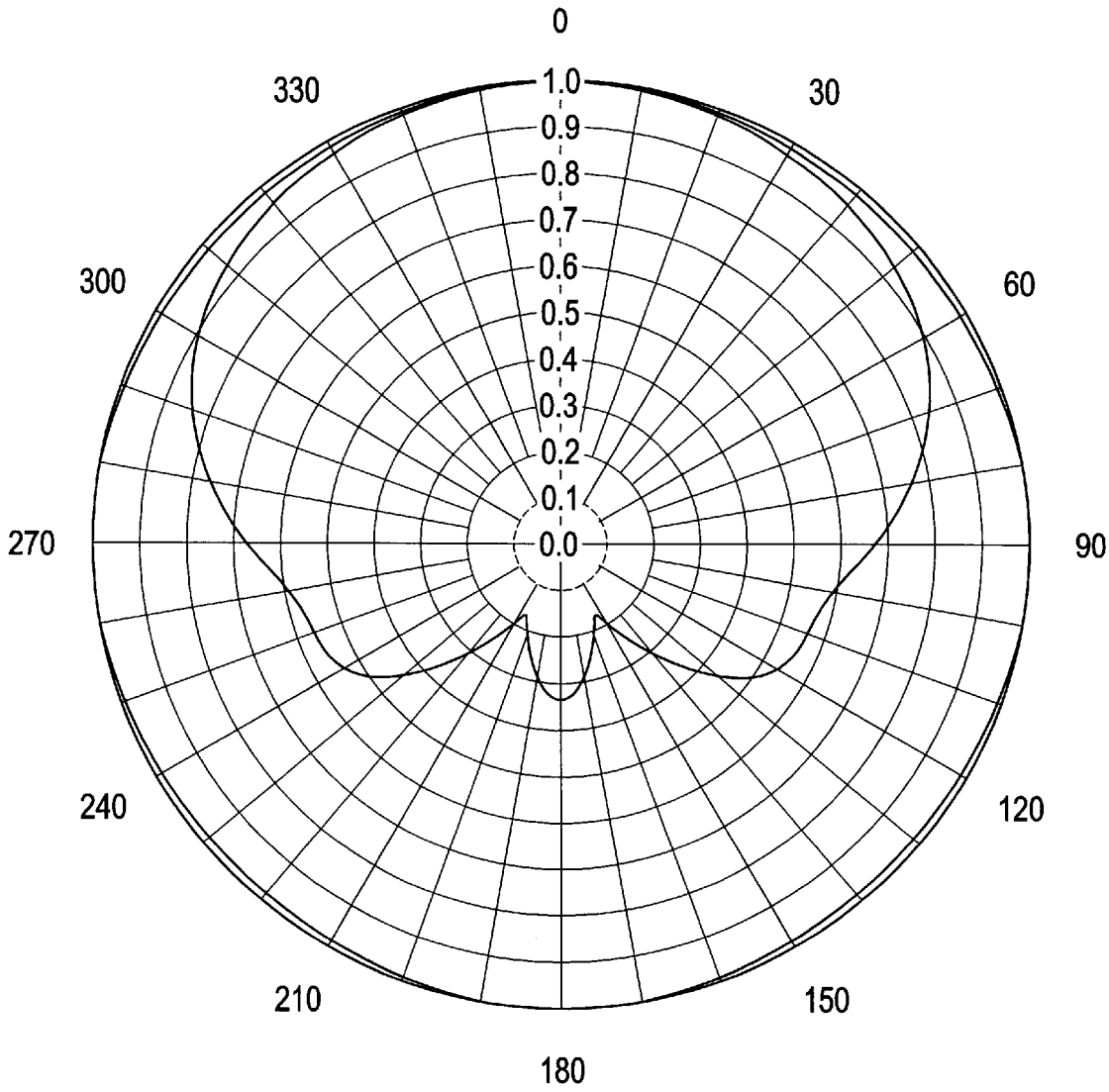
FIG. 8 is a graph depicting UHF and VHF azimuth patterns corresponding to the slotted coaxial antenna design of FIG. 7.

For instance, if VHF coupled slot 8 is rotated approximately 45 degrees to the right, then all four VHF coupled slots 8, 10, 12, 14 are positioned at 45, 135, 225 and 315 degrees, respectively. Accordingly, UHF coupled slot 22 is also shifted 45 degrees to the right, such that it is positioned at 0 degrees. Empty tubes 90, 92, 94 are positioned at 90, 180 and 270 degrees, respectively. The azimuth pattern corresponding to the slotted coaxial antenna design of FIG. 7 is shown in FIG. 8.

Figure 9:
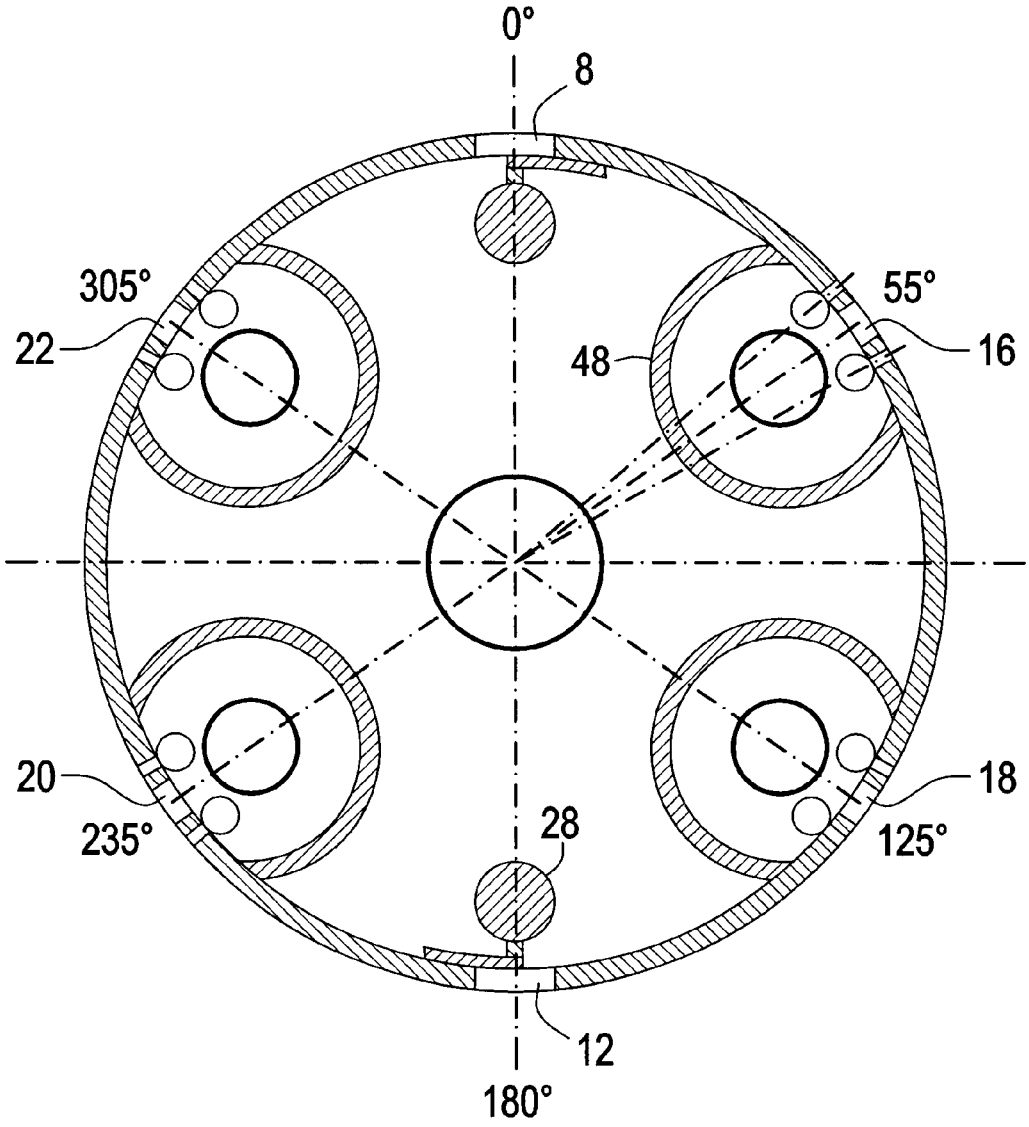
FIG. 9 is a top view of a fourth embodiment of the common aperture slotted coaxial antenna of the present invention.

Referring to FIG. 9, there is shown a top view of a fourth embodiment of the common aperture slotted coaxial antenna of the present invention. In this configuration, orientation of the VHF coupled slot 8 and associated coupler 24 remains at the zero degree position, but each UHF coupled slot 16, 18, 20, 22 is positioned approximately 55 degrees apart; namely, at 55, 125, 235 and 305 degrees, respectively.

Figure 10:
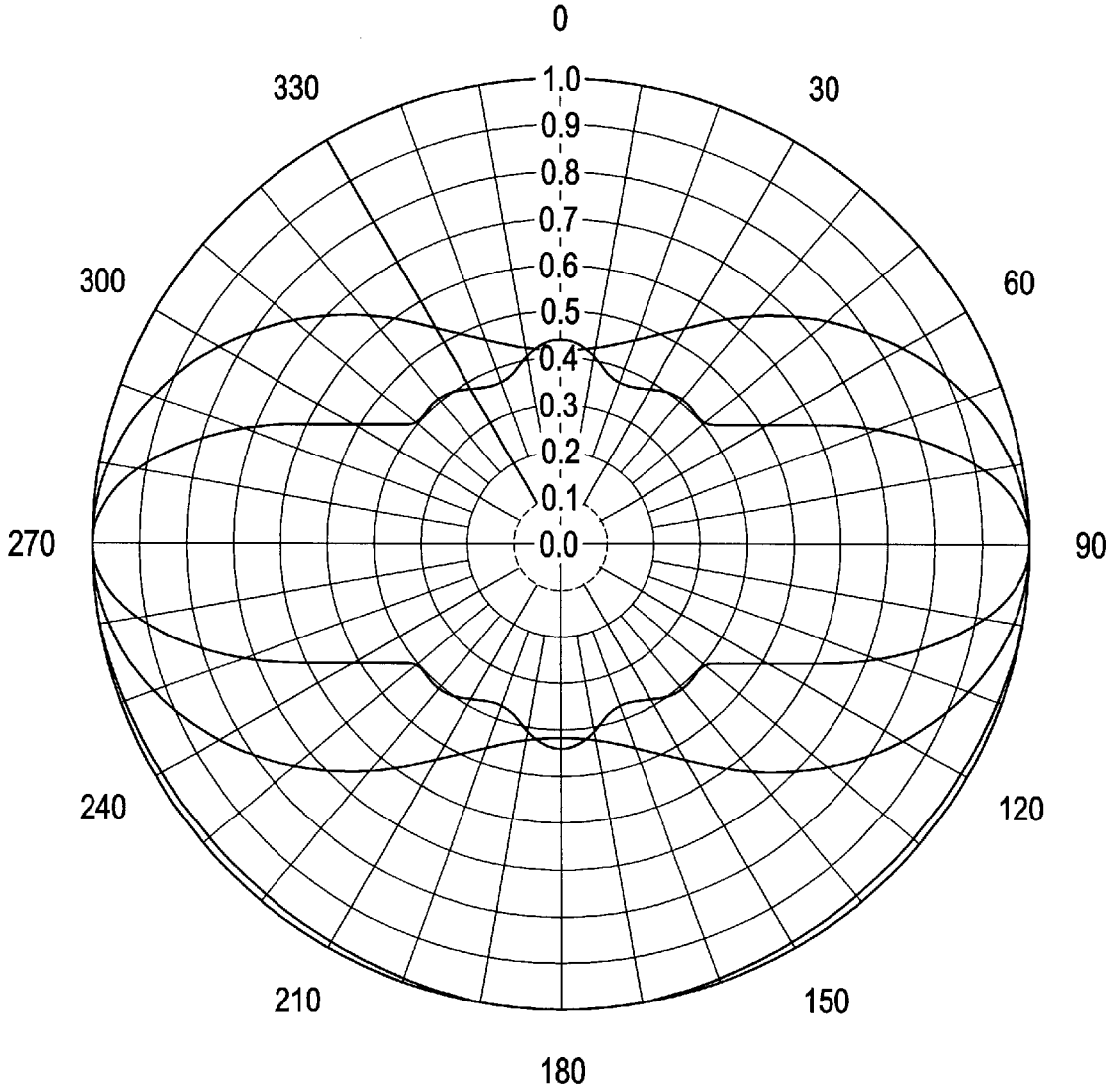
FIG. 10 is a graph depicting UHF and VHF azimuth patterns corresponding to the slotted coaxial antenna design of FIG. 9.

In addition to a change in orientation, the present embodiment presents changes to the number of VHF couplers. More specifically, the number of VHF couplers have been reduced from four in FIG. 1 to two 24, 28, which are positioned at approximately zero and 180 degrees, respectively, as shown in FIG. 9. The azimuth pattern corresponding to the slotted coaxial antenna design of FIG. 9 is shown in FIG. 10.

It is now apparent that the antenna system design of the present invention has a number of features and advantages over the prior art, particularly in respect to increased broadband bandwidth capabilities, minimal tower wind loading, and improved antenna output response performance suitable for both digital TV transmission systems and NTSC antenna systems, etc.

While the invention has been described in terms of various preferred embodiments, those skilled in the art will recognize that the many features and advantages of the invention are apparent from the detailed specification, and that various modifications, substitutions, omissions and changes can be made without departing from the spirit of the present invention.

Accordingly, it is intended that all suitable modifications and equivalents may be resorted to as falling within the scope of the invention.

What is claimed is:

1. A slotted coaxial antenna for simultaneous DTV and NTSC broadcast, said antenna comprising:

(a) an elongated hollow mast having a VHF inner conductor;

(b) one or more VHF coupled slots in an outer periphery of said mast; and (c) one or more UHF coupled slots alternatively interspersed between said one or more VHF coupled slots.

2. The slotted coaxial antenna according to claim 1, wherein each said one or more VHF coupled slots comprises a longitudinally extending VHF slot and a VHF coupler extending over a portion of said VHF slot.

3. The slotted coaxial antenna according to claim 2, wherein said VHF coupler is locate d within said mast between each end of said VHF slot.

4. The slotted coaxial antenna according to claim 1, wherein each said one or more UHF coupled slots comprise a longitudinally extending UHF slot and a UHF coupler extending along said UHF slot.

5. The slotted coaxial antenna according to claim 4, wherein said UHF coupler is located within said mast between each end of said UHF slot.

6. The slotted coaxial antenna according to claim 4, wherein said UHF coupler is formed as part of a UHF slotted coaxial antenna.

7. The slotted coaxial antenna according to claim 6, wherein said VHF inner conductor comprises a VHF slotted coaxial antenna.

8. The slotted coaxial antenna according to claim 7, wherein said VHF inner conductor acts as a common aperture for each UHF slotted coaxial antenna and each VHF coupler arranged inside of said mast.

9. The slotted coaxial antenna according to claim 1, wherein said VHF inner conductor comprises a VHF slotted coaxial antenna.

10. The slotted coaxial antenna according to claim 1, further comprising a power divider used to reduce a plurality of inputs to a single connection.

11. The slotted coaxial antenna according to claim 1, wherein at least one of a position of VHF or UHF slots around said mast, number of VHF of UHF slots in said mast, number of fins attached to said mast, and external lines places in an aperture of said antenna, is changeable to achieve a desired VHF and UHF broadcast.

12. A method of transmitting DTV and NTSC broadcast signals, comprising the steps of:

transmitting DTV and NTSC signals to a slotted coaxial antenna; and radiating said DTV and NTSC signals simultaneously, wherein said slotted coaxial antenna has an elongated hollow mast having a VHF inner conductor, one or more VHF coupled slots in an outer periphery of said mast, and one or more UHF coupled slots alternatively interspersed between said one or more VHF coupled slots.

13. The method according to claim 12, wherein said one or more VHF coupled slots has at least one VHF coupler which extends inwardly from said one or more VHF coupled slots toward said VHF inner conductor.

14. The method according to claim 13, wherein said at least one VHF coupler is secured to said mast by a bracket.

15. The method according to claim 14, wherein said bracket is made of aluminum.

16. The method according to claim 12, wherein said one or more UHF coupled slots has at least one UHF coupler which is arranged along the length of said one or more UHF coupled slots.

17. A slotted coaxial antenna for transmitting DTV and NTSC signals, comprising:

VHF inner conducting means;

elongated hollow outer conducting means;

VHF coupling means on said outer conducting means; and

UHF coupling means on said outer conducting means, wherein said VHF coupling means and said UHF coupling means are located around the periphery of said hollow outer conducting means.

18. The slotted coaxial antenna of claim 17, wherein said hollow outer conducting means is made of at least one of aluminum and steel.

19. The slotted coaxial antenna of claim 17, wherein said VHF coupling means includes at least one VHF coupler.

20. The slotted antenna of claim 17, wherein said UHF coupling means includes at least one UHF coupler.

* * * * *